United States Patent [19]

Kaufmann

[11] 4,036,264

[45] July 19, 1977

[54] LOOM HARNESS

[75] Inventor: Frank H. Kaufmann, Greenville, S.C.

[73] Assignee: Steel Heddle Manufacturing Company, Greenville, S.C.

[21] Appl. No.: 708,119

[22] Filed: July 23, 1976

[51] Int. Cl.[2] ..... D03C 9/06

[52] U.S. Cl. ..... 139/92

[58] Field of Search ..... 139/92, 91, 82

[56] References Cited

U.S. PATENT DOCUMENTS

| | | | |
|---|---|---|---|
| 1,009,050 | 11/1911 | Cote | 139/92 |
| 3,362,437 | 1/1968 | Kaufmann | 139/92 |
| 3,430,313 | 3/1969 | Koch | 139/92 X |
| 3,901,282 | 8/1975 | Kramer et al. | 139/92 |

FOREIGN PATENT DOCUMENTS

| | | | |
|---|---|---|---|
| 517,071 | 1/1940 | United Kingdom | 139/92 |

*Primary Examiner*—James Kee Chi

*Attorney, Agent, or Firm*—Zachary T. Wobensmith, 2nd; Zachary T. Wobensmith, III

[57] ABSTRACT

A heddle frame for weaving looms is disclosed having heddle supporting rods detachably carried by the top and bottom rails of the heddle frame, the rods being made in a plurality of interengaging sections.

8 Claims, 10 Drawing Figures

LOOM HARNESS

BACKGROUND OF THE INVENTION

1. Field of the Invention

This invention relates to heddle frames for weaving looms and more particular to detachable sectional heddle supporting rods.

2. Description of the Prior Art

It has heretofore been the common practice to employ, in harness frames for weaving looms, heddle supporting rods which were continuously extended from end to end in the frame and were secured at their ends to the side struts of the frame, and which were supported intermediate their ends at a plurality of locations by supports extending from the harness frame rails.

The use of aligned sectional supports for heddles has heretofore been proposed.

Kurmann, in U.S. Pat. No. 632,726 showed the use on heddle frame rails of a plurality of aligned channels with flanges and slots, the heddles being slidable along the slots and having enlarged heads for retention in the channels. No structure is provided for maintaining the alignment of the channels which, if bent, would prevent the sliding of the heddles along the slots.

Cote, in U.S. Pat. No. 1,009,050, showed a loom harness frame in which the heddle supporting rails consisted of aligned elongated flattened tubular bodies of thin sheet metal with internal connecting tongues secured to one of the tubular bodies at one end and detachably slidable into the end of an adjoining tubular body. It is extremely difficult to obtain a tubular body of requisite hardness and of the small size required made of sheet metal while at the same time having an interior space of a size to receive the tongue. Endwise removal of one of the end sections is required for access to the other sections. This Cote construction would be wholly unsuited to meet present day rigorous demands.

Pfarrwaller, in U.S. Pat. No. 2,700,399 shows loom harness in which the heddle bars are in sections, are carried at their outer ends in end struts and at their inner ends in the intermediate frame rails or posts, in overlapping or abutting relation.

The interposition of the frame posts would restrict the end to end movement of the heddles on the rails in addition to the obstructions to such movement at the supports 15.

The sectional heddle bars heretofore referred to because of their shortcomings have had, so far as is known, little if any public acceptance and are unsuited for modern usage.

SUMMARY OF THE INVENTION

In accordance with the invention a harness frame for looms is provided in which the heddle supporting rods are in aligned separately removable sections, are supported from and by the harness frame rails to maintain their parallelism, permit free and unobstructed horizontal movement of the heddles, and are provided with joints which maintain rod alignment vertically and horizontally, the rods being joined at an angle to prevent catching of the heddles at the joints.

It is the principal object of the invention to provide a heddle frame having a heddle supporting rod of aligned removable sections each supported from a heddle frame rail and with joints between adjoining sections which provides greater rigidity from end to end of the composite heddle rod.

It is a further object of the invention to provide a heddle frame having a heddle supporting rod of aligned separately removable sections permitting easier access to heddles intermediate the ends of the frame.

It is a further object of the invention to provide a heddle frame having a heddle supporting rod of aligned separately removable heddle rod supporting sections with a simple but effective joint between sections.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
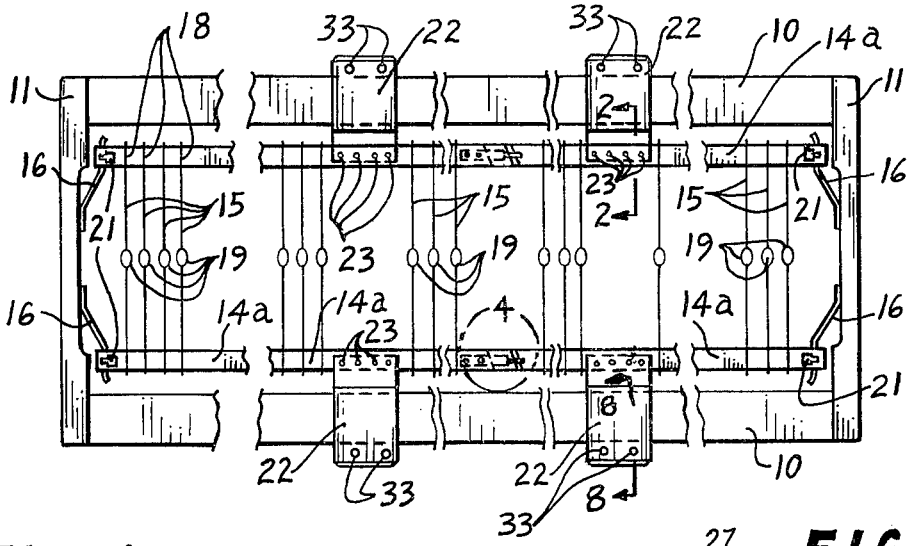
FIG. 1 is a front elevational view of a heddle frame for looms having the present invention incorporated therein.
Figure 2:
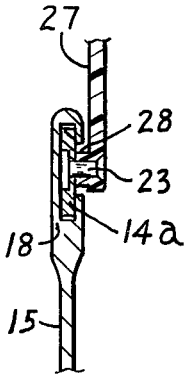
FIG. 2 is a fragmentary vertical sectional view, enlarged, taken approximately on the line 2—2 of FIG. 1 and showing the mounting of an upper heddle end eye on the heddle rod.
Figure 4:
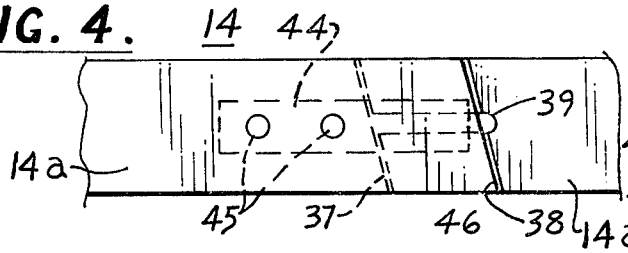
FIG. 4 is a front elevational view, enlarged, showing a preferred mode of joining a pair of successive heddle rod sections and taken at the location 4 of FIG. 1.
Figure 3:
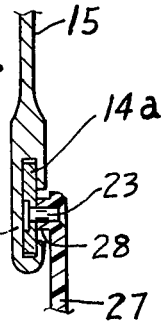
FIG. 3 is a vertical sectional view, enlarged, showing the mounting of a lower heddle end eye on the heddle rod.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to FIGS. 1 to 7 of the drawings in which a preferred embodiment of the invention is illustrated, a heddle frame is shown having top and bottom rails or shafts 10 connected at their ends by struts 11. The rails 10 may be of any desired material such as wood, metallic tubing of steel, plated to resist corrosion or rusting, or of extruded aluminum or aluminum alloy.

The struts 11 can be of any suitable material, secured to the rails or shafts 10 at their ends in any desired manner.

The heddle rods 14, upon which heddles 15 are slidably supported, as hereinafter more fully described, are secured at their ends by spring brackets 16 of well known type.

The heddles 15 can be of any suitable type with end eyes 18 and warp eyes 19 intermediate their ends. One suitable type of heddle 15 is that shown in FIGS. 2 and 3 of U.S. Pat. No. 2,047,511 but the invention is not restricted to specific heddles.

The upper and lower heddle rods 14, substantially rectangular in vertical cross section, are made in a plurality of aligned parts 14a.

The endmost parts or sections 14*a* have apertures 21 for engagement by the spring hooks 16.

Each heddle rod part or section 14*a* has a rail attachment member 22 secured thereto intermediate its ends by a plurality of rivets 23 the rail attachment members 22 being detachably secured respectively to the top and bottom rails 10.

The rail attachment member 22 can be of any desired type, suitable rail attachments being shown in the U.S. Pat. Nos. to Kramer, 3,417,788 and Kaufmann, et al., 3,470,920. A preferred rail attachment, however, is that shown in the U.S. Pat. No. to Kramer, et al., 3,901,282.

As illustrated, the rail attachment members 22 each includes separate components 24 and 25, of molded synthetic plastic having a low coefficient of friction when in rubbing contact with metal rails as well as being tough, resilient, inert and free from any tendency to soil the fabric being woven.

The component 24 has a wall portion 26 for engagement with a rail 10, with an extension 27 having a spacer rib 28 formed thereon through which the rivets 33 extend.

The component 25 preferably has a hook rib 30 in engagement with a slot 31 on the component 24, a wall portion 32 parallel to the wall portion 26 for engagement with a rail 10 and is preferably detachably connected to the component 24 by projections or snap fingers 33 on the component 24 engaged in apertures 34 in the component 25, similar to those shown in the Kramer, et al. U.S. Pat. No. 3,901,282.

The rail sections 14*a* are connected at their meeting ends so as to be relatively rigid and free from separation vertically and horizontally and for this purpose a preferred connection is shown in detail in FIGS. 4 to 7, inclusive.

One of the rail sections 14*a,* at one end, is reduced to half its thickness to provide a face 36, is provided with an angularly disposed end face as at 37, an inner margin 38 parallel to the end face 37 is provided, and a centrally disposed longitudinal slot 39 is provided extending inwardly from the end face 37.

The other of the rail sections 14*a,* at the end meeting the adjoining section 14*a* is reduced to half its thickness to provide a face 41 with an angularly disposed end face 42 and an inner margin 43 parallel to the end face 42. A key 44 is attached to the other of the rail sections 14*a* by rivets 45 in overlapping relation to the face 41. The key 44 has a rib 46 for reception in the slot 39.

The connection thus provided for the adjoining sections 14*a* by the engagement of the rib 46 in the slot 39 prevents occurrence of relative vertical movement. The key 44 by its engagement with the exterior face of the adjoining section 14*a* retains the faces 36 and 41 in engagement and prevents relative horizontal movement.

Any section may be readily detached by separation of its rail attaching member 22 from the rail 10. The separation can be effected by the use of a screw driver to separate the components 24 and 25 for release of the attaching member 22. The spring bracket 16 can then be released from its engagement with the end of the heddle rod 14 so that it can be moved horizontally outside the frame strut 11 and to an extent to permit the separation of the desired connection.

Figure 9:
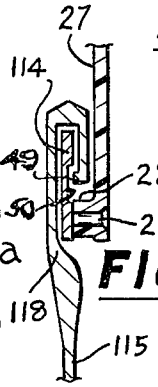
FIG. 9 is a view similar to FIG. 2 showing a different heddle rod and upper heddle end eye.
Figure 5:
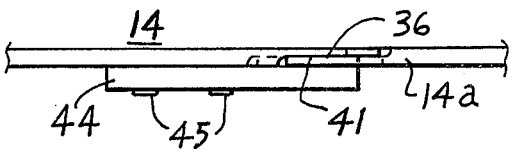
FIG. 5 is a top plan view of the structure shown in FIG. 4.
Figure 8:
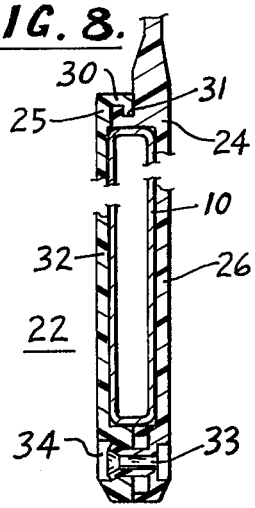
FIG. 8 is a vertical sectional view taken on the line 8—8 of FIG. 1.
Figure 6:
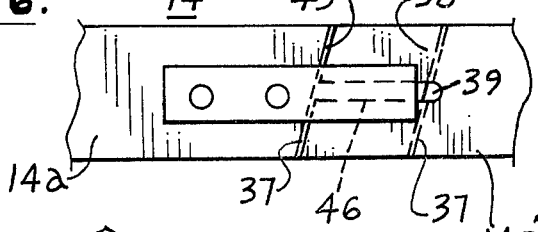
FIG. 6 is a rear elevational view of the structure shown in FIG. 4.
Figure 6:
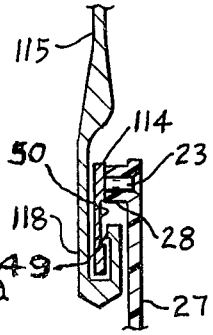
Figure 7:
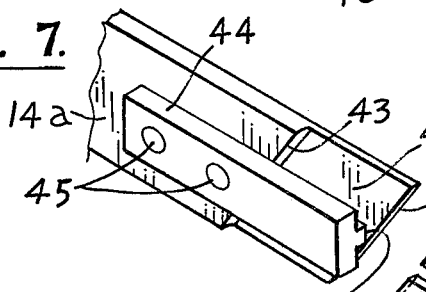
FIG. 7 is a fragmentary view in perspective showing a pair of successive heddle rod sections in separated condition.
Figure 10:
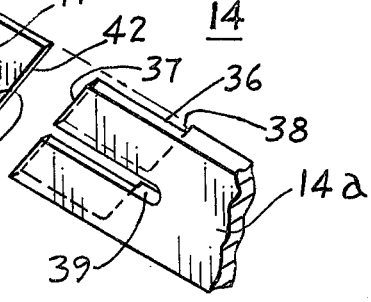
FIG. 10 is a view similar to FIG. 3 showing the heddle rod of FIG. 8 and the lower heddle end eye.

In FIGS. 9 and 10 a modified form of sectional heddle rod 114 is shown with its respective sections connected to the extensions 27 of the rail attachment members 22 by rivets 23. The end eyes 118 of the heddles 115 have inwardly disposed projections 49 movable along grooves 50 in the sectional heddle rods 114.

I claim:

1. The combination with a heddle frame having top and bottom rails, and a plurality of heddles in said frame of upper and lower heddle rods parallel to and in spaced relation to said rails for carrying said heddles, each of said heddle rods comprising a plurality of aligned rod sections with opposite outer vertical continuous aligned faces, certain of said rod sections having secured thereto a rail attachment member for engagement with one of said rails, means for retaining meeting ends of aligned rod sections against horizontal and vertical displacement, said means including interengaging vertical face portions intermediate said vertical faces and extending inwardly from the ends of said rod sections, and a member for holding said face portions in engagement.

2. A heddle frame as defined in claim 1 in which said rail attachment member has separable components for retaining said member on its associated rail.

3. A heddle frame as defined in claim 1 in which said rail attachment member has separable components held together by snap members.

4. A heddle frame as defined in claim 1 in which said last mentioned means comprises a slidable connection between said meeting ends.

5. A heddle frame as defined in claim 1 in which the terminal portions of meeting ends of said aligned rod sections are angularly disposed to reduce the tendency of the heddles to engage therewith.

6. The combination as defined in claim 1 in which each of said rod sections has one of said rail attachment members secured thereto.

7. The combination as defined in claim 1 in which said member comprises a horizontally disposed key on one of said meeting ends with a horizontal portion in engagement in a horizontal slot in the other of said meeting ends.

8. The combination defined in claim 1 in which each of said meeting ends has an inclined terminal end face parallel to terminal end face of the other meeting end, one of said meeting ends has a horizontal slot extending inwardly from its terminal end face, the other of said meeting ends has a horizontally disposed key secured thereto, and said key has a portion horizontally slidably engageable with said slot for retaining said meeting ends against horizontal and vertical displacement with respect to the main plane of the heddle frame.

* * * * *